US005955239A

United States Patent [19]

Haydock et al.

[11] Patent Number: 5,955,239

[45] Date of Patent: Sep. 21, 1999

[54] STRIPPABLE BIAXIALLY ORIENTED BASE FOR IMAGING ELEMENT

[75] Inventors: Douglas N. Haydock, Webster; Thaddeus S. Gula, Rochester; Peter T. Aylward, Hilton; Robert P. Bourdelais, Pittsford, all of N.Y.

[73] Assignee: Eastman Kodak Company, Rochester, N.Y.

[21] Appl. No.: 08/998,160

[22] Filed: Dec. 24, 1997

[51] Int. Cl.[6] ..... G03C 1/805; G03C 1/79; G03C 8/52; G03C 11/12

[52] U.S. Cl. ..... 430/212; 430/215; 430/227; 430/256; 430/263; 430/536; 430/538

[58] Field of Search ..... 430/263, 536, 430/538, 215, 256, 212, 227

[56] References Cited

U.S. PATENT DOCUMENTS

| | | | |
|---|---|---|---|
| 4,187,113 | 2/1980 | Mathews et al. | 430/533 |
| 4,283,486 | 8/1981 | Aono et al. | 430/538 |
| 4,377,616 | 3/1983 | Ashcraft et al. . | |
| 4,632,869 | 12/1986 | Park et al. . | |
| 4,758,462 | 7/1988 | Park et al. . | |
| 4,912,333 | 3/1990 | Roberts et al. . | |
| 4,994,312 | 2/1991 | Maier et al. . | |
| 5,429,916 | 7/1995 | Ohshima | 430/538 |
| 5,466,519 | 11/1995 | Shirakura et al. | 430/538 |
| 5,476,708 | 12/1995 | Reed et al. | 430/538 |
| 5,514,460 | 5/1996 | Surman et al. . | |

FOREIGN PATENT DOCUMENTS

| | | |
|---|---|---|
| 0 803 377 A1 | 10/1997 | European Pat. Off. . |

*Primary Examiner*—Richard L. Schilling
*Attorney, Agent, or Firm*—Paul A. Leipold

[57] ABSTRACT

The invention relates to a photographic element comprising a paper base, at least one photosensitive silver halide layer, a layer of biaxially oriented polyolefin sheet between said paper base and said silver halide layer, wherein there is located between said biaxially oriented polyolefin sheet and said base paper a layer of strippable material comprising a material that has a peel strength of between about 30 and 150 g/5 cm.

20 Claims, No Drawings

STRIPPABLE BIAXIALLY ORIENTED BASE FOR IMAGING ELEMENT

FIELD OF THE INVENTION

This invention relates to imaging materials. In a preferred form it relates to base materials particularly for photographic color papers.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult requiring great care and expense to ensure proper laydown and cooling of the polyethylene layers. One defect in prior formation techniques is caused when an air bubble is trapped between the forming roller and the polyethylene which will form the surface for casting of photosensitive materials. This air bubble will form a pit that will cause a defect in the photographic performance of photographic materials formed on the polyethylene. It would be desirable if a more reliable and improved surface could be formed at less expense.

In color papers there is a need for providing color papers with improved resistance to curl as proposed in U.S. patent application Ser. No. 08/864,228 filed May 23, 1997. Present color papers will curl during development and storage. Such curl is thought to be caused by the different properties of the layers of the color paper as it is subjected to the developing and drying processes. Humidity changes during storage of color photographs lead to curling. There are particular problems with color papers when they are subjected to extended high humidity storage such as at greater than 50% relative humidity. Extremely low humidity of less than 20% relative humidity also will cause photographic papers to curl.

In photographic papers the polyethylene layer also serves as a carrier layer for titanium dioxide and other whitener materials as well as tint materials. It would be desirable if the colorant materials rather than being dispersed throughout the polyethylene layer could be concentrated nearer the surface of the layer where they would be more effective photographically.

The utilization of currently available photographic papers includes treatment that extends beyond the photoprocessing and typical trimming operations. In many cases the additional treatments are performed on portraits or large format commercial images to enhance and provide a distinctive visual appearance to the image. Examples of such treatments include liquid sprays, protective laminations, surface embossing, and lamination to materials of highly textured surfaces. In the lamination of an image to a highly textured surface the thickness of the substrate supporting said photographic image will directly influence the extent of the transfer of the texture to the viewer. Reducing the thickness of the image layer is necessary to provide the desired visual effect. Current practice to reduce the thickness of the image layer involves the stripping of the photographic image layer and the adjacent polyethylene layer from the paper core of current photographic papers. The stripping of the image layer and adjacent polyethylene layer from the paper substrate found in current papers is difficult and time consuming due to variability in the cohesion and adhesion properties found in the layers comprising the photographic materials. During the stripping process, an operator will provide uniform pull force to separate the image layers from the substrate. Non-uniform force can cause fracture of the photographic material at an interface other than that between the polyethylene layer and the paper substrate or in the most severe case, damage to the image.

It has been proposed in U.S. Pat. No. 5,244,861 to utilize biaxially oriented polypropylene in receiver sheets for thermal dye transfer.

PROBLEM TO BE SOLVED BY THE INVENTION

There is a need to provide a uniform and reliable separation of the image forming layer from the supporting substrate to more effectively perform a variety of image presentation operations. There is further a need to provide user options for image utilization.

SUMMARY OF THE INVENTION

An object of the invention is to provide improved imaging materials.

A further object is to provide a improved photographic papers.

These and other objects of the invention generally are accomplished by an imaging element comprising a paper base, an image forming layer, a layer of microvoided biaxially oriented polyolefin sheet between said paper base and said image forming layer, wherein said microvoided biaxially oriented polyolefin sheet serves as a carrier for the image forming layer, and a strippable bonding agent located between said microvoided biaxially oriented polyolefin sheet and said paper base.

Another embodiment of the invention is accomplished by a method of forming an imaging element comprising providing a pre-formed biaxially oriented polyolefin microvoided sheet, providing a base paper, applying a strippable bonding agent onto said base paper and simultaneously applying said microvoided sheet to said strippable bonding agent to join said microvoided sheet to said base paper.

ADVANTAGEOUS EFFECT OF THE INVETION

The invention provides an improved base for imaging materials. It particularly provides improved removal of the image and adjacent carrier layer from the supporting substrate by applying a strippable bonding agent between the image and the said substrate for color photographic materials. Such image removal provides a reduction in the overall thickness of the final image as needed in the application of a stripped image to a highly textured surface for visual enhancement, such as image lamination to fabric. Reduced image thickness also provides differential space advantages during attachment to documents and archival storage. In the case where the imaging carrying layer is transparent, this invention permits the creation of an image viewable by transmission or for display when under rear illumination.

DETAILED DESCRIPTION OF THE INVENTION

There are numerous advantages of the invention over prior practices in the art. The invention provides a thin carrier layer for the image forming layer. This thin carrier layer is substantially resistant to tearing and allows said thin carrier layer and the attached image layer to be removed from the underlying substrate with less damage to the image during the removal process. This invention further enhances the removal of the thin carrier layer and the image layer by providing an adhesive bonding layer of reduced bonding strength. Reduced bonding strength of the layer between said thin carrier layer and the underlying substrate provides the advantage of requiring lower force to propagate and complete the image stripping process.

In one current practice, the image forming layer and adjacent polyethylene layer is removed from the photographic paper base and adhered to a material with a textured surface, such as fabric, to provide an alternate visual appearance. In this particular treatment where a photographic image is laminated to a highly textured surface the thickness of the substrate supporting said photographic image will directly influence the extent of the transfer of the texture to the viewer. Reducing the thickness of the image layer therefore increases the transfer of the pattern of the said highly textured surface and enhances the desired visual effect. Current practice to reduce the thickness of the image layer involves the stripping of the photographic image layer and the adjacent polyethylene layer from the paper core of current photographic papers. The stripping of the image layer and adjacent polyethylene layer from the paper substrate found in current papers is difficult and time consuming due to variability in the cohesion and adhesion properties of the component layers comprising currently available photographic materials. It has been found that slow uniform pull force on the layers being removed is useful in overcoming the sudden changes in bonding strength found in current photographic materials. Image stripping is performed by human hand, generally assisted by a hard cylindrical device on which the stripped layer can be wound. A second cylinder is sometimes used behind the image layer capturing cylinder to increase stability and provide a more uniform force during image removal. Failure to provide uniform force to the layer being removed will result in fracture of the photographic material at an interface other than that between the polyethylene layer and the paper substrate or in the most severe case, damage to the image layer rendering the image useless. Due to the difficulties in starting and uniformly separating the polyethylene layer from the photographic paper support during the stripping operation on currently available photographic materials, loss from damage is often incurred. The strippable layer of this invention increases the reliability of uniform image removal and increases the productivity of such operations. It further decreases or eliminates both the material waste and additional imaging time required for remaking an image destroyed during the stripping process.

In another current practice, photographic images are attached to or included with documents or other publications to provide high quality graphical information. The strippable layer of this invention provides a final image of substantially reduced thickness and stiffness. An image of substantially reduced thickness and stiffness has the advantage of lower weight when compared to current photographic materials. This has a direct impact on mailing, shipping, or any other weight or thickness related considerations. The reduced thickness and stiffness image provided by this invention further has the advantage of reducing the differential height of attaching or including such an image in document or envelope. Reduced differential height provides increased stackability and decreased handling damage during the life of such documents. The reduced thickness and stiffness provided by this invention also has the advantage of requiring less space for a stack of images. This is of particular advantage in storage applications, such as photo albums or in wallet display sleeves.

An additional advantage is a new application made possible by this invention to provide the creation of a transmission or display image from the same web of photographic media as that used for reflective prints by including a transparent image carrying layer. The use of a strippable layer adjacent to a transparent image carrying layer permit the user to separate the image and clear carrying layer from the opaque substrate, allowing a variety of display options.

The determination of the force to separate the image carrying layer from the underlying substrate is measured in units of grams. This separation force is measured using an Instron Tensile instrument. The width of the sample to be tested, the speed at which the sample is separated, and the angle at which the separation occurs are critical to understanding the force of separation. The samples used in this study were 5 cm in width with a head speed of 1.0 meter per minute at an angle of 180°. Photographic materials currently available require 500 grams per 5 centimeter length of line of separation to separate the polyethylene layer from the photographic paper base. Separation forces of at least 30 g/5 cm are required to avoid unwanted separation. A preferred range of separation force is between 30 and 150 g/5 cm. These and other advantages wil be apparent from the detailed description below.

The terms as used herein, "top", "upper", "emulsion side", and "face" mean the side or toward the side of the member bearing the imaging layers. The terms "bottom", "lower side", and "back" mean the side or toward the side of the member opposite from the side bearing the imaging layers or developed image.

Any suitable biaxially oriented polyolefin sheet may be used for the sheet on the top side of the laminated base of the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

$$\frac{\text{Composite Sheet Density}}{\text{Polymer Density}} \times 100 = \%\text{ of Solid Density}$$

should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 $\mu$m, preferably from 20 to 70 $\mu$m. Below 20 $\mu$m, the microvoided sheets may not be thick enough to minimize any inherent non-planarity in the support and would be more difficult to manufacture. At thicknesses higher than 70 $\mu$m, little improvement in either surface smoothness or mechanical properties are seen, and so there is little justification for the further increase in cost for extra materials.

The biaxially oriented sheets used in the invention preferably have a water vapor permeability that is less than $0.85\times10^{-5}$ g/mm$^2$ day/atm. This allows faster emulsion hardening during formation, as the laminated invention support slows the rate of water vapor transmission from the emulsion layers during coating of the emulsions on the support. The transmission rate is measured by ASTM F1249.

"Void" is used herein to mean devoid of added solid and liquid matter, although it is likely the "voids" contain gas. The void-initiating particles which remain in the finished packaging sheet core should be from 0.1 to 10 $\mu$m in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5–50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the crosslinked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethylpropane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, and limited coalescence directly yield very uniformly sized particles.

The void-initiating materials may be coated with a agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin film is utilized.

For the biaxially oriented sheets on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tinge is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, and coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a typical biaxially oriented, microvoided sheet of the invention is as follows:

| |
|---|
| solid skin layer |
| microvoided core layer |
| solid skin layer |

The biaxially oriented sheet on the side of the base paper opposite to the emulsion layers may be any suitable sheet. The backside sheet may or may not be microvoided. It may have the same composition as the sheet on the top side of the paper backing material. Biaxially oriented sheets are conveniently manufactured by coextrusion of the sheet, which may contain several layers, followed by biaxial orientation. Such biaxially oriented sheets are disclosed in U.S. Pat. No. 4,764,425.

The preferred biaxially oriented sheet is a biaxially oriented polyolefin sheet, most preferably a sheet of polyethylene or polypropylene. The thickness of the biaxially oriented sheet should be from 10 to 150 μm. Below 15 μm, the sheets may not be thick enough to minimize any inherent non-planarity in the support and would be more difficult to manufacture. At thicknesses higher than 70 μm, little improvement in either surface smoothness or mechanical properties are seen, and so there is little justification for the further increase in cost for extra materials.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with layers of the same polymeric material, or it can be made with layers of different polymeric composition. For compatibility, an auxiliary layer can be used to promote adhesion of multiple layers.

Addenda may be added to the biaxially oriented sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The biaxially oriented sheet on the backside of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

The structure of a typical backside biaxially oriented sheet of the invention is as follows:

| |
|---|
| treated skin layer |
| solid core layer |

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312; and 5,055,371, the disclosure of which is incorporated by reference.

The prefered support is a photographic grade cellulose fiber paper. When using a cellulose fiber paper support, it is preferable to extrusion laminate the microvoided composite sheets to the base paper using a melt extruded polyolefin resin. Extrusion lamination is carried out by bringing together the biaxially oriented sheets of the invention and the base paper with application of an melt extruded adhesive or strippable material, between them followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper.

The adhesive may be any suitable material that does not have a harmful effect upon the photographic element such as chemical sensitization of the silver halide layer. The adhesive may be any suitable polyolefin resin that can be melt extruded at about 160° C. to 300° C. For use in this invention the adhesive may be any suitable material that will provide a bond strength to paper between about 30 and 150 grams/5 cm. A preferred material is polyethylene with a density greater than 0.92. Polyethylene with a density greater than 0.92 will have a more regular, aligned structure with less discontinuities that will result in lower bond strength to biaxially oriented polyolefins of this invention. Polyethylene with a density less than 0.92 has a more irregular chain shape with holes and gaps that will result in a high, unacceptable bond strength to the biaxially oriented sheets of this invention. Polyethylene adhesives are also low in cost and are relatively easy to melt extrude when compared to alternative adhesive materials.

During the lamination process, it is possible to also reduce the bond strength between the paper and biaxially oriented sheets of this invention by reducing the melt temperature of the adhesive. As the melt temperature decreases, the bond strength between the biaxially oriented sheet and the adhesive will decrease to zero bond strength. The bond strength of the adhesive between the cellulose paper and the biaxially oriented film may also be reduced by the elimination of sheet pre treatments that are known to increase bond strength. Treatments such as corona discharge, flame and plasma can be reduced or eliminated to reduce the bond strength to the desired level.

In one preferred embodiment, in order to produce photographic elements with a desirable photographic look and feel, it is preferable to use relatively thick paper supports (e.g., at least 120 mm thick, preferably from 120 to 250 mm thick) and relatively thin microvoided composite packaging films (e.g., less than 50 mm thick, preferably from 20 to 50 mm thick, more preferably from 30 to 50 mm thick).

As used herein the phrase "imaging element" is a material that may be used as a laminated support for the transfer of images to the support by techniques such as ink jet printing or thermal dye transfer as well as a support for silver halide images. As used herein, the phrase "photographic element" is a material that utilizes photosensitive silver halide in the formation of images. In the case of thermal dye transfer or ink jet, the image receiving layer that is on the imaging element may be any material that is known in the art such as gelatin, pigmented latex, polyvinyl alcohol, polycarbonate, polyvinyl pyrrolidone, starch and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979). Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 A1 (Yamada), and EP 0 435355 A1 (Makino).

The photographic elements of this invention may use emulsions doped with Group VIII metals such as iridium, rhodium, osmium, and iron as described in *Research Disclosure,* September 1994, Item 36544, Section I, published by Kenneth Mason Publications, Ltd., Dudley Annex, 12*a* North Street, Emsworth, Hampshire PO107DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

In the following table, reference will be made to (1) *Research Disclosure,* December 1978, Item 17643, (2) *Research Disclosure,* December 1989, Item 308119, and (3) *Research Disclosure,* September 1994, Item 36544, all published by Kenneth Mason Publications, Ltd., Dudley Annex, 12*a* North Street, Emsworth, Hampshire PO107DQ, ENGLAND. The table and the references cited in the table are to be read as describing particular components suitable for use in the elements of the invention. The table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 | I, II, III, IX A & B | hardeners, coating aids, addenda, etc. |
| 1 | III, IV | Chemical sensitization and |
| 2 | III, IV | spectral sensitization/ |
| 3 | IV, V | desensitization |
| 1 | V | UV dyes, optical bright- |
| 2 | V | eners, luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IXC & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII,XIX, XX | |
| 3 | XIV | Scanning and digital processing procedures |

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated.

Commercial Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26 anionic polyacrylamide, and 5.0% $TiO_2$ on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

EXAMPLES

Example 1

The following laminated photographic bases (table I) were prepared by extrusion laminating the following biaxially oriented polyolefin sheets to both the top and bottom sides of a photographic grade cellulose paper base:

Top sheet: (Emulsion side)

OPPalyte 350 ASW (Mobil Chemical Co.)

A composite sheet (31 mm thick) (d=0.68 g/cc) consisting of a microvoided and oriented polypropylene core (approximately 60% of the total sheet thickness), with a homopolymer non-microvoided oriented polypropylene layer on each side; the void initiating material used is poly(butylene terephthalate).

Bottom sheet: (Backside)

BICOR 70 MLT (Mobil Chemical Co.)

A one-side matte finish, one-side treated polypropylene sheet (18 mm thick) (d=0.9 g/cc) consisting of a solid oriented polypropylene core. The matte finish side is exposed on the back surface of the laminated photographic base.

Two bonding layer resins were used to laminate the above films to both sides of a photographic grade cellulose paper base. The first bonding layer was a low density polyethylene (LDPE) manufactured by Eastman Chemical Company (1924P). 1924P is a extrusion grade low density polyethylene with a density of 0.923 g/cm3 and a melt index of 4.2. The second bonding layer used was a high density polyethylene (HDPE) manufactured by Eastman Chemical Company (605P). 605P is a extrusion grade high density polyethylene with a density of 0.960 g/cm3 and a melt index of 7.0.

After the photographic bases were assembled, Coating Format I was utilized to prepare photographic print materials utilizing the supports listed above.

| Coating Format I | Laydown mg/m$^2$ |
|---|---|
| Layer 1 | |
| Blue Sensitive Layer | |
| Gelatin | 1300 |
| Blue sensitive silver | 200 |
| Y-1 | 440 |
| ST-1 | 440 |
| S-1 | 190 |
| Layer 2 | |
| Interlayer | |
| Gelatin | 650 |
| SC-1 | 55 |
| S-1 | 160 |
| Layer 3 | |
| Green Sensitive Layer | |

-continued

| | |
|---|---|
| Gelatin | 1100 |
| Green sensitive silver | 70 |
| M-1 | 270 |
| S-1 | 75 |
| S-2 | 32 |
| ST-2 | 20 |
| ST-3 | 165 |
| ST-4 | 530 |
| Layer 4 | |
| UV Interlayer | |
| Gelatin | 635 |
| UV-1 | 30 |
| UV-2 | 160 |
| SC-1 | 50 |
| S-3 | 30 |
| S-1 | 30 |
| Layer 5 | |
| Red Sensitive Layer | |
| Gelatin | 1200 |
| Red sensitive silver | 170 |
| C-1 | 365 |
| S-1 | 360 |
| UV-2 | 235 |
| S-4 | 30 |
| SC-1 | 3 |
| Layer 6 | |
| UV Overcoat | |
| Gelatin | 440 |
| UV-1 | 20 |
| UV-2 | 110 |
| SC-1 | 30 |
| S-3 | 20 |
| S-1 | 20 |
| Layer 7 | |
| SOC | |
| Gelatin | 490 |
| SC-1 | 17 |
| $SiO_2$ | 200 |
| Surfactant | 2 |

APPENDIX

Y-1

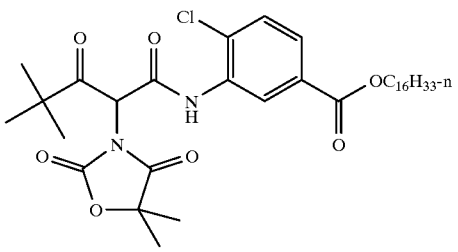

ST-1 = N-tert-butylacrylamide/n-butyl acrylate copolymer (50:50)
S-1 = dibutyl phthalate

SC-1

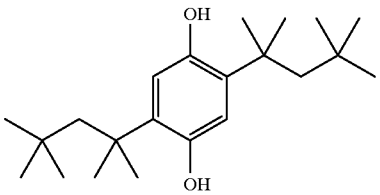

-continued

M-1

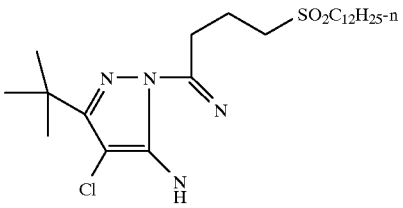

S-2 = diundecyl phthalate

ST-2

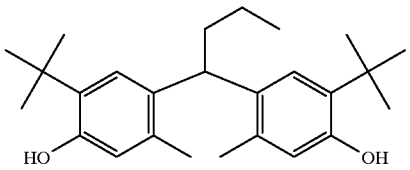

ST-3

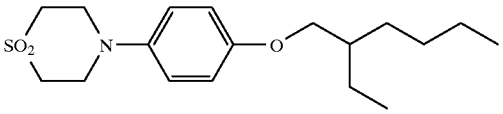

ST-4

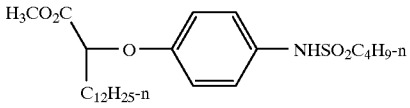

UV-1

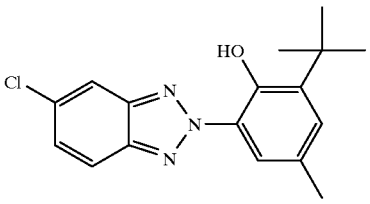

UV-2

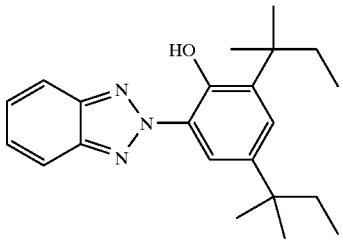

S-3 = 1,4-Cyclohexyldimethylene bis(2-ethylhexanoate)

C-1

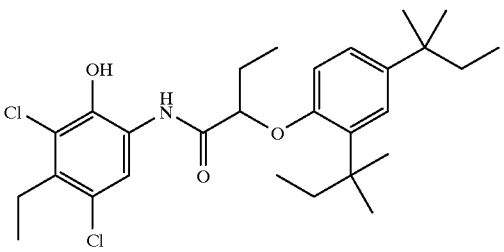

S-4 = 2-(2-Butoxyethoxy)ethyl acetate

-continued

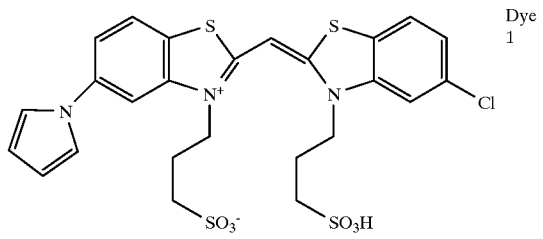

Dye 1

Photographic images were then printed and developed on each of the photographic bases using standard photofinishing equipment.

TABLE I

| Feature | Resin Type | Melt Temp (C.) | Bonding Layer thickness ($\mu$m) | CDT | Peel Strength (g/5 cm) |
|---|---|---|---|---|---|
| A | LDPE | 325 | 12.8 | OFF | 41.3 |
| B | LDPE | 293 | 12.8 | ON | 44.7 |
| C | HDPE | 325 | 12.8 | ON | 37.8 |
| D | HDPE | 293 | 12.8 | ON | 14.4 |

The melt temperature in Table I is the exit temperature, in degrees Celsius, of the resin from the slit extrusion die. The bonding layer thickness in Table I is the thickness, measured in $\mu$m, of the bonding layer between the biaxially oriented sheets and the cellulose paper base. The CDT column in Table I indicates if the CDT (corona discharge unit) applied to the cellulose paper base (used to improve adhesion) was either on or off. The peel strength, measured in grams, is the separation force between the cellulose paper base and the backside sheet. The separation force was measured using an Instron. The test used was the 180 degree peel test with a crosshead speed of 1.0 meter/min. The sample width was 5 cm and the distance peeled was 10 cm. The peel strength readings in Table I are an average of 9 individual readings.

Photographic bases A–C had a separation force that allowed the bases to be successfully transported through the photofinishing process without separation of the image from the paper base. In the final image format, the images were easily separated from the paper base as compared to standard color photographic paper. During the photofinishing of base D separation of the image from the base paper occurred and caused several unacceptable transport failures. Images printed on base D were of no commercial value indicating too low a peel strength.

The invention has been described in detail with particular reference to preferred embodiments thereof, but it will be understood that variations and modifications can be effected within the spirit and scope of the invention.

We claim:

1. A photographic element comprising a paper base, at least one photosensitive silver halide layer, a layer of biaxially oriented polyolefin sheet between said paper base and said silver halide layer, wherein there is located between said biaxially oriented polyolefin sheet and said base paper a layer of strippable material comprising a material that has a peel strength of between about 30 and 150 g/5 cm.

2. The photographic element of claim 1 wherein said stripable material comprises at least one material selected from the group consisting of polypropylene, polyethylene, polymethylpentene, polystyrene, polybutylene, copolymers of propylene and ethylene and mixtures thereof.

3. The photographic element of claim 1 wherein said strippable material is polyethylene strippable material.

4. The photographic element of claim 1 wherein said polyethylene strippable material has a density greater than 0.920.

5. The photographic element of claim 1 wherein the bond between the biaxially oriented sheet and the strippable layer separates during stripping.

6. The photographic element of claim 1 wherein the surface of the biaxially oriented film adjacent to the strippable layer has limited adherence to the material of the strippable layer.

7. The photographic element of claim 1 wherein said biaxially oriented film has a Young's modulus between about 700 MPa to 5500 MPa.

8. The photographic element of claim 1 wherein said strippable material contains at least one pigment selected from the group consisting of talc, kaolin, calcium carbonate, $BaSO_4$, ZnO, $TiO_2$, ZnS, $MgCO_3$, and carbon.

9. The photographic element of claim 1 wherein said strippable material contains titanium dioxide.

10. A method of stripping a photographic image comprising providing a photographic element comprising a paper base, at least one photosensitive silver halide layer, a layer of biaxially oriented polyolefin sheet between said paper base and said silver halide layer, wherein there is located between said biaxially oriented polyolefin sheet and said base paper a layer of strippable material comprising a material that has a peel strength of between about 30 and 150 g/5 cm, exposing said element, developing said element and stripping the image and said polyolefin sheet from said base paper.

11. An imaging element comprising a support base, at least one image receiving layer, a layer of biaxially oriented polyolefin sheet between said base and said image receiving layer, wherein there is located between said biaxially oriented polyolefin sheet and said support base a layer of strippable material comprising a material that has a peel strength of between about 30 and 150 g/5 cm.

12. An imaging element of claim 11 wherein said stripable material comprises at least one material selected from the group consisting of polypropylene, polyethylene, polymethylpentene, polystyrene, polybutylene, copolymers of propylene and ethylene and mixtures thereof.

13. An imaging element of claim 11 wherein said strippable material is polyethylene strippable material.

14. An imaging element of claim 11 wherein the bond between the biaxially oriented sheet and the strippable layer separates during stripping.

15. The photographic element of claim 11 wherein the surface of the biaxially oriented film adjacent to the strippable layer has limited adherence to the material of the strippable layer.

16. The photographic element of claim 1 further comprising a biaxially oriented sheet on the bottom of said photographic element.

17. The photographic element of claim 16 wherein said paper is a cellulose fiber paper.

18. The photographic element of claim 17 wherein the bottom biaxially oriented sheet comprises polyolefin.

19. The imaging element of claim 11 further comprising a biaxially oriented sheet on the bottom of said photographic element.

20. The imaging element of claim 19 wherein said paper is a cellulose fiber paper.

* * * * *